US007350589B2

(12) United States Patent
Head

(10) Patent No.: US 7,350,589 B2
(45) Date of Patent: Apr. 1, 2008

(54) TELEMETERING SYSTEM

(76) Inventor: Philip Head, Gibb House, Kennel Ride, Ascot, Berks SL5 7NT (GB)

( * ) Notice: Subject to any disclaimer, the term of this patent is extended or adjusted under 35 U.S.C. 154(b) by 216 days.

(21) Appl. No.: 10/515,615

(22) PCT Filed: May 21, 2003

(86) PCT No.: PCT/GB03/02189

§ 371 (c)(1),
(2), (4) Date: Nov. 19, 2004

(87) PCT Pub. No.: WO03/097992

PCT Pub. Date: Nov. 27, 2003

(65) Prior Publication Data

US 2005/0167121 A1 Aug. 4, 2005

(30) Foreign Application Priority Data

May 21, 2002 (GB) ..... 0211668.9
Jun. 1, 2002 (GB) ..... 0212865.0

(51) Int. Cl.
*E21B 19/00* (2006.01)

(52) U.S. Cl. ..... 166/385; 166/380; 340/855.1

(58) Field of Classification Search ..... 166/385, 166/54.5–54.6; 340/854.9, 855.1
See application file for complete search history.

(56) References Cited

U.S. PATENT DOCUMENTS 2,809,435 A * 10/1957 Nicolson et al. ..... 33/737
3,330,338 A * 7/1967 Dozier ..... 166/338
3,904,840 A * 9/1975 Kostelnicek ..... 340/855.1
3,963,854 A * 6/1976 Fowler ..... 174/36
4,031,969 A * 6/1977 Cullen et al. ..... 175/65
4,716,960 A * 1/1988 Eastlund et al. ..... 166/60
6,041,872 A * 3/2000 Holcomb ..... 175/40
6,392,317 B1 * 5/2002 Hall et al. ..... 307/90

* cited by examiner

*Primary Examiner*—David Bagnell
*Assistant Examiner*—Giovanna M Collins
(74) *Attorney, Agent, or Firm*—Andrew Wilford

(57) ABSTRACT

A pipe installation system has a pipe composed of sections that are added and removed to increase and decrease a length of the pipe. The system further has a cable storage spool for stowing a length of cable in a compact manner inside the pipe and for paying out the stowed cable when the length of the pipe is increased such that the paid-out cable is deployed along the increased length of the pipe. An anchoring assembly attaches the cable to an inside surface of the pipe at predetermined locations spaced along the pipe with respective anchors as the cable is deployed in the pipe.

16 Claims, 23 Drawing Sheets

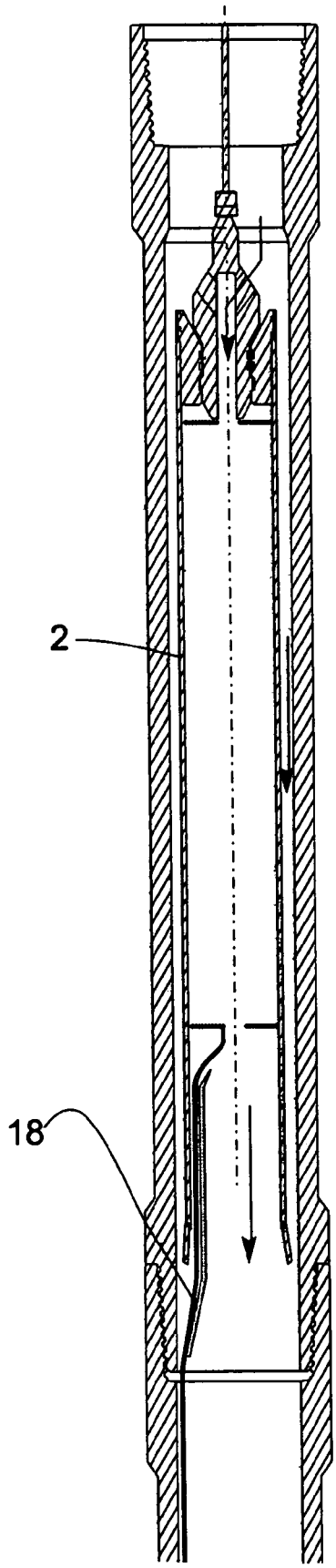
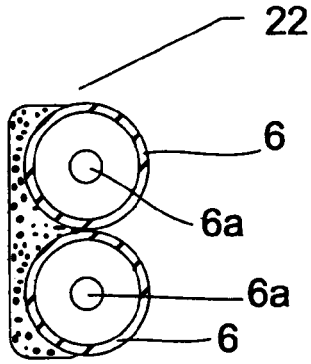
Fig. 7a
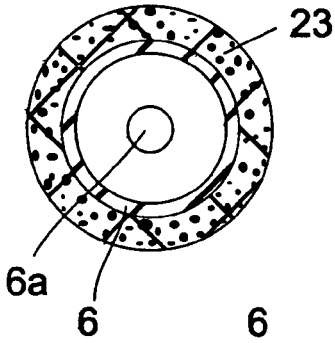
Fig. 7b
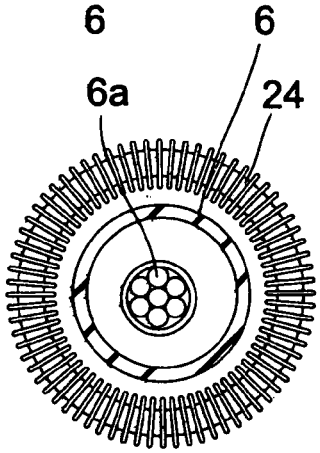
Fig. 7c
FIG 7

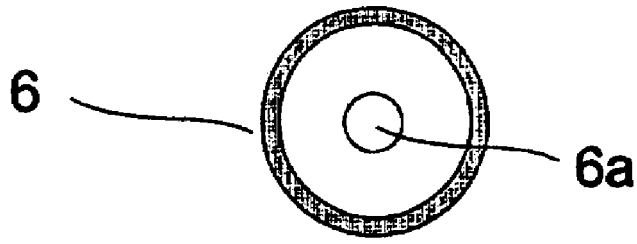
Fig.10a
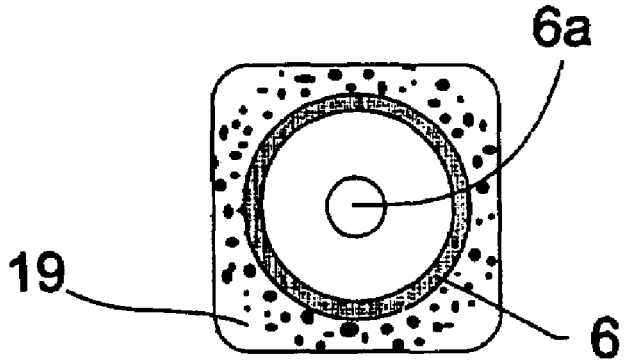
Fig. 10b
Fig. 10c
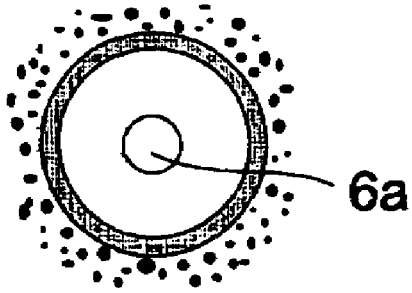
Fig. 10d
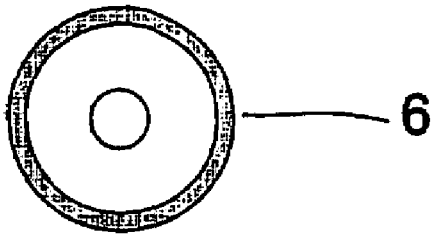

FIG 24
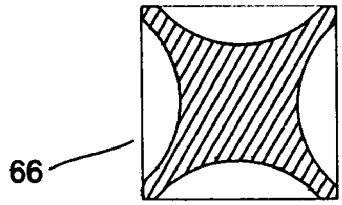
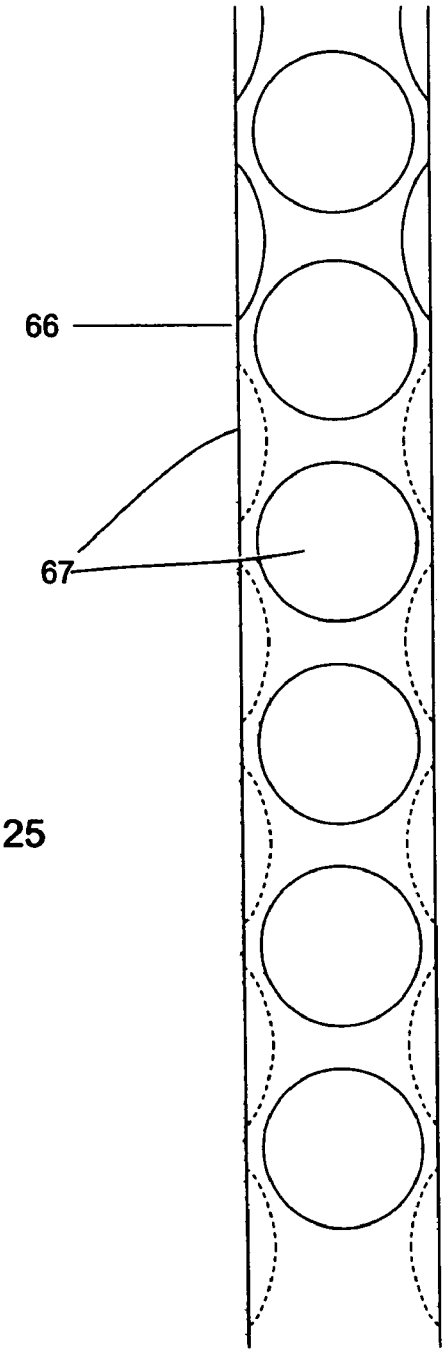
FIG 25

TELEMETERING SYSTEM

CROSS REFERENCE TO RELATED APPLICATIONS

This application is the U.S. national phase of PCT application PCT/GB03/02189 filed 21 May 2003 with a claim to the priority of British patent application 0211668.9 itself filed 21 May 2002 and British patent application 0212865.0 itself filed 1 Jun. 2002.

BACKGROUND OF THE INVENTION

Field of the Invention

The present invention relates to a telemetering system, in particular, one mounted in a drillpipe.

The conventional manner of drilling a borehole comprises lowering a drill bit into the earth, the drill bit being powered, for instance, by the rotation of the drillpipe, or by fluids circulating through the drillpipe and thence back up to the surface through the space between the drillpipe and the borehole. The drillpipe is made up of sections, new sections being added periodically at the top of the drillpipe string to allow the drill bit to be lowered further.

Much useful data can be garnered from sensors included in the drillpipe, such as temperature and pressure. To retrieve this information at the surface requires some form of media to transmit it through. Known systems include using pressure waves through the circulating mud, and electromagnetic pulses. Better rates of transfer and less attenuation may be achieved however by using an electrical conducting element.

The simplest way of installing a conducting cable, or indeed any line, along the drillpipe string is to wait until drilling has ceased and lower a single length down the drillpipe string. Where it is necessary to take readings from instrumentation means before the drillpipe is completed however, the cable must be lowered into the drillpipe string, only to be withdrawn each time a new drillpipe section is added to the drillpipe string.

One known method comprises a drillpipe incorporating conducting elements. The conducting elements of adjoining sections of drillpipe are electrically connected by sliding contacts. Such a system is expensive, and liable to develop faults as a result of fluid contaminating the connection. Many telemetry systems rely upon a segmented cable running through the drillpipe, cable sections being added in order to allow fresh sections of drillpipe to be added.

Every connection between individual lengths of cable provides a further opportunity for faults to occur.

OBJECT OF THE INVENTION

The object of the present invention is to provide an apparatus and method for disposing reliable telemetric equipment in drillpipes and the like in an efficient manner.

SUMMARY OF THE INVENTION

According to the present invention a pipe installation system has a pipe string composed of pipe sections which are added and removed to increase and decrease the length of the pipe. A length of cable is mounted within the pipe string, there being a cable storage means for stowing the cable in a compact manner and paying out the cable when the length of the pipe is increased such that the paid-out cable is deployed in the increased length of pipe. Anchoring means are provided which serve to attach the cable to an inside wall of the pipe following deployment of the cable in the pipe.

Preferably the anchors are attached to the cable at predetermined positions along the length of the cable. Preferably the anchors position themselves in an anchoring position as the cable is paid out. Preferably the anchors consist of a ring shaped wire which correspond approximately to the inside diameter of the pipe.

Alternatively and anchoring means may be provided by the cable being magnetic and attaching itself to the inside wall of the pipe magnetically. Preferably the cable includes a sheath of effectively permanently magnetizable material, such as steel, the sheath being magnetized shortly before deployment.

Alternatively the magnetic attractiveness could be provided by a magnetic flexible tape attached to the conductor or a complete outer layer. The anchoring means could also be provided by suction means.

Alternatively the anchoring means may be provided by the inside wall of the pipe and activated as the spool passes through the pipe.

Preferably the spool includes a cable feeder which guides the cable to the desired position inside the pipe. Preferably this is against the inside wall of the pipe.

Preferably the cable storage means is a bobbin upon which the cable is wound. The cable may include a wireless transmitter capable of transmitting signals to a signal receiver. The cable is preferably releasably connected to a connector at its top, the cable being disconnected from the connector when a pipe section is to be added or removed, threaded through the pipe section before being reconnected to the connector, the cable including a wireless transmitter, such that signals carried by the cable can be transmitted by the wireless transmitter to be received by a signal receiving means.

According to a further aspect of the present invention, there is provided a method of removing a cable installed along a pipe string or the like, and fixed to the inside wall thereof by anchoring means, the pipe string being composed of pipe sections which are removed as the removal of the pipe string progresses, a length of cable being mounted within the pipe string, a cable removing means being releasably connected to a connector at its top, the cable removing means being adapted to remove the cable and the cable anchors.

The cable removal means preferably includes means for applying a solvent to dissolve part of the cable or its anchoring means.

BRIEF DESCRIPTION OF THE DRAWING

A telemetering system will now be described, by way of example only for a drill pipe and not intended to be limiting, with reference to the drawings, of which;

FIG. 7 shows a similar view to FIG. 3 of an alternative embodiment of the anchoring means provided by a magnetic means on the cable;

FIG. 7*a* shows an embodiment of a magnetic means in the form of a magnetic tape;

FIG. 7*b* shows an embodiment of the magnetic means in the form of a magnetic layer;

FIG. 7*c* shows an embodiment of a magnetic means being provided by magnetizing a steel sheath around the cable;

FIGS. 10*a* to 10*d* show an embodiment of a magnetic attaching means and its removal;

FIG. 24 is a cross section of a cable according to a further embodiment of the invention, FIG. 25 is a longitudinal elevation of the cable of FIG. 24;

SPECIFIC DESCRIPTION

Figure 1:
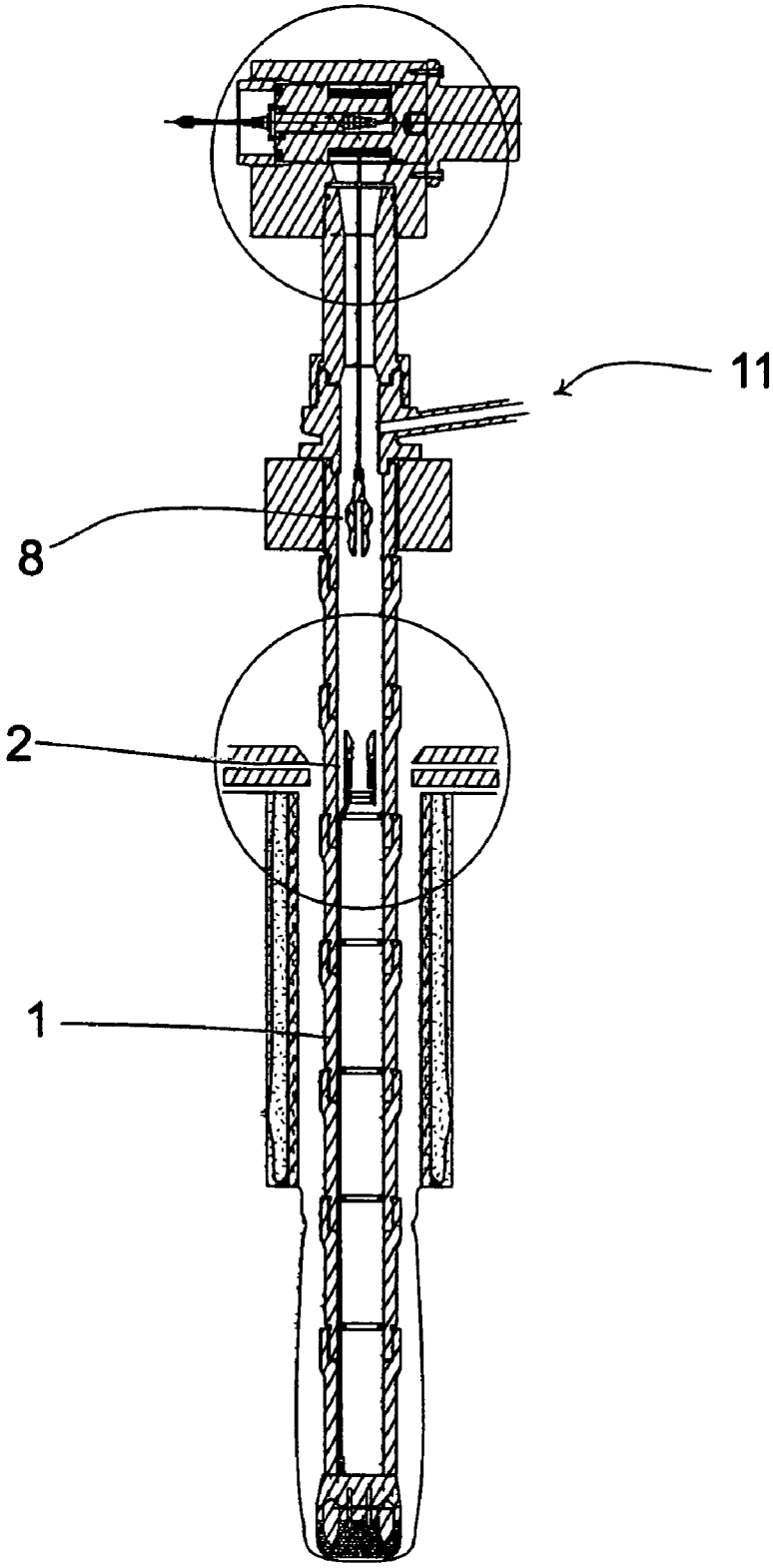
FIG. 1 shows a longitudinal section of a drillpipe string installed in the well at surface.

FIG. 1 shows the drilling assembly 1 lowered into a well with a cable module 2 installed in the internal bore.

Figure 2:
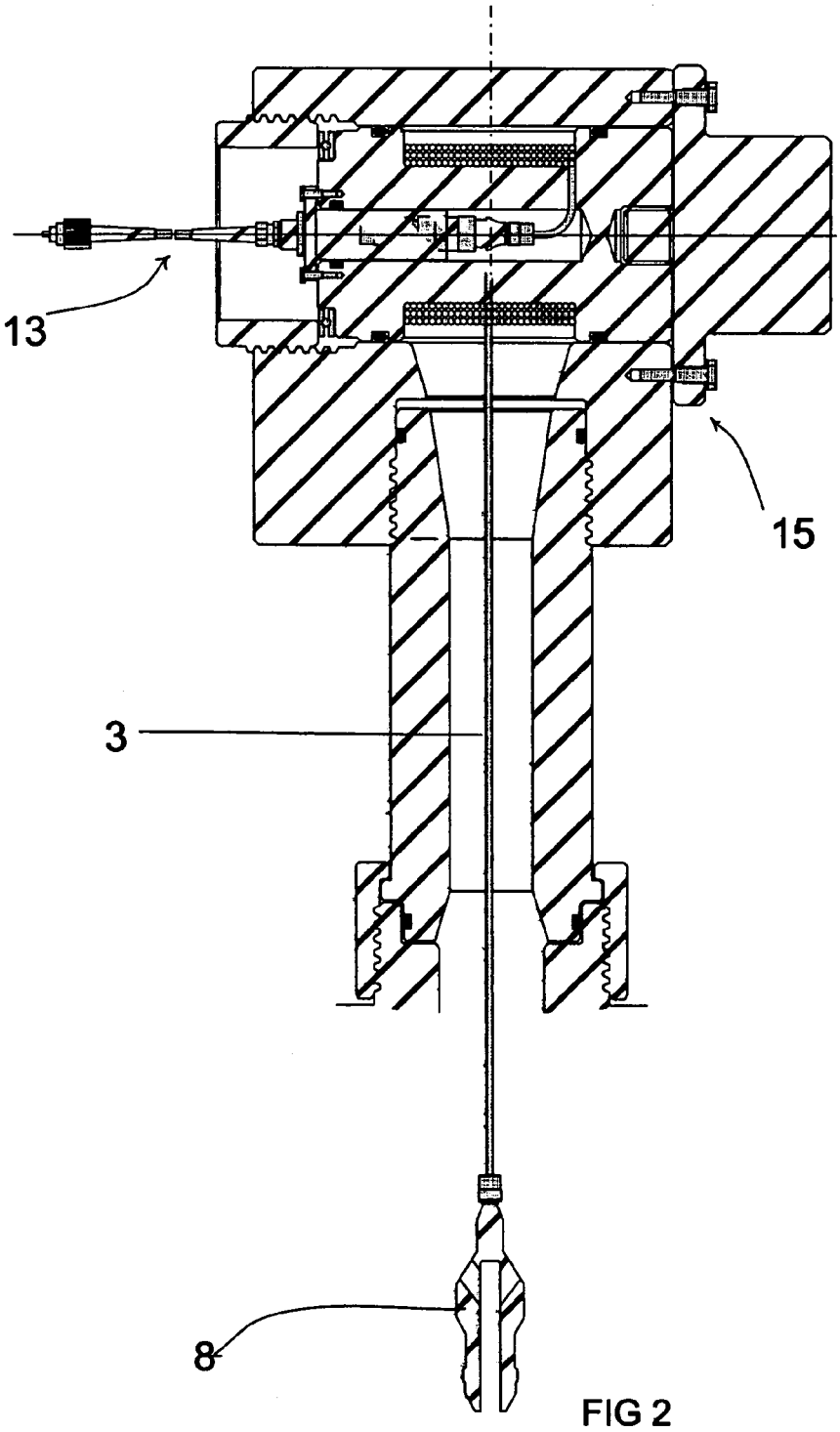
FIG. 2 shows an enlarged view of the top of the drill pipe of FIG. 1 showing the connection means for the cable spool.

The drill assembly is advanced down the well by a top drive with standard fluid entry above a goose neck 11 in the conventional way. As shown in FIG. 2, the cable module is attached to a connection means in a winch assembly above the top drive. When the drill string's progression down the bore hole makes it necessary to add another pipe section to the drill string, the cable module 2 is disconnected from the connection means and allowed to rest upon an anchor 5 (FIG. 3) which holds it in position against the drillpipe. The new pipe section is added to the existing drillpipe, and the top drive and winch assembly connected to the drillpipe. The winch means is ideally driven by an electric motor 13 supplied through a slip ring assembly 15. Further details of the connection means and winch assembly are discussed in greater detail below. When the top drive is secured to the new pipe section, the connection means are lowered through the new pipe assembly until they engage with the cable module 2. The drill pipe proceeds downwards as the drilling progresses and the cable module pays out the cable 6 along the length of the drill pipe until the top end of the new pipe section is reached and the process is repeated.

The method of data transfer between a stinger 8 of the connection means and a fishing socket 9 of the cable module 2 is preferably by an inductive link. In this way, data may be continuously transmitted throughout the drilling process, by induction when the fishing socket 9 is engaged or close to the stinger 8 when the fishing socket are separated, and may transmit even when new drill pipe sections are being added.

Figure 3:
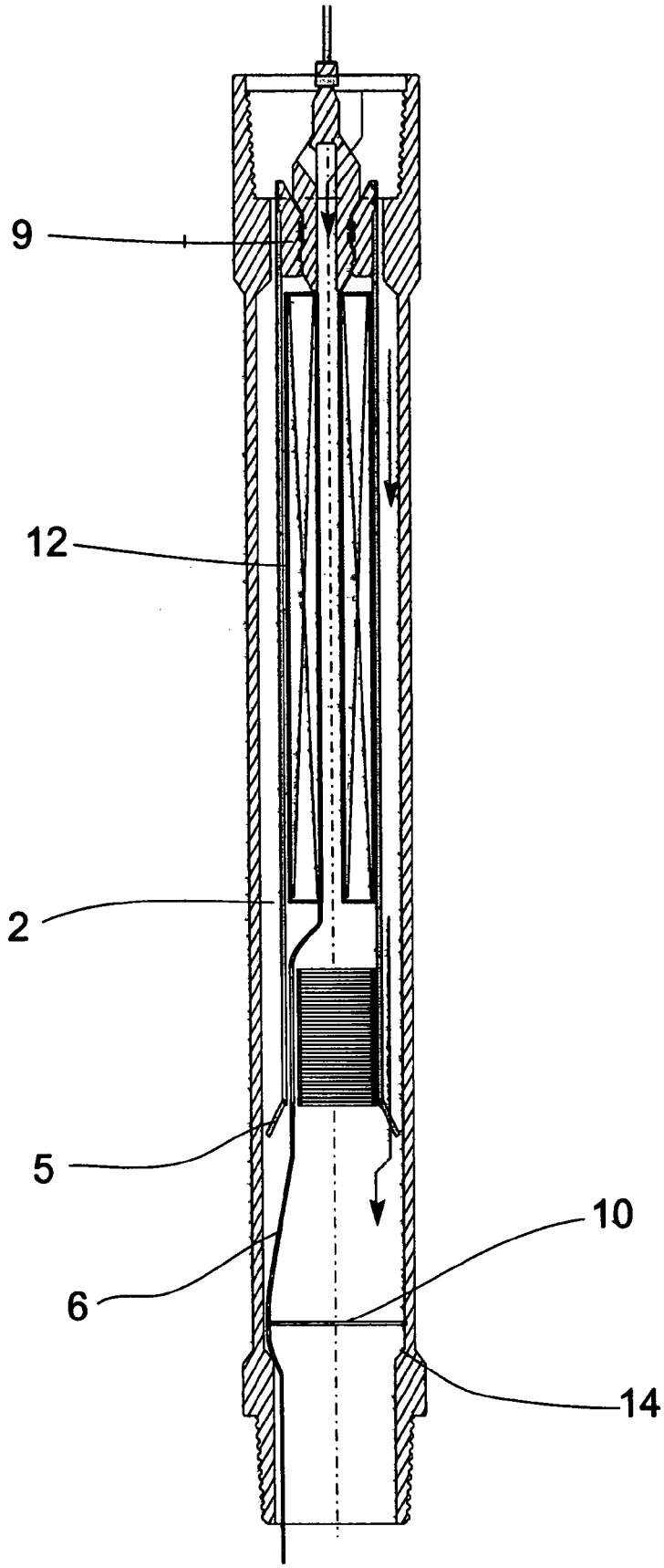
FIG. 3 shows an enlarged view of FIG. 1 in the region of the spool as a section of drill pipe is being deployed.

Referring to FIG. 3, an enlarged view of the cable module 2 is shown as a section of drill pipe is being deployed. The cable module includes a storage container 12 in which is stored the armored cable to be installed in the drill pipe. The cable 6 is fed out of the storage container 12 as it is pulled out with the running tool. Cable anchors 10 are stored below the cable storage container 12 and arranged so that after a desired length of cable has been paid out an anchor will be released and will fall into position to anchor the cable against the upset of the inside wall of the drill pipe. In this embodiment the anchor is a ring shaped anchor corresponding to the inside diameter of the drill pipe and which presses the cable 6 against an internal upset or rim 14 on the inside wall of the drill pipe normally present at the joining point of the drill pipe section. The anchors 10 could be arranged to be deployed one for each length of drill pipe but it is preferably only required to deploy them at ever 3 to 5 joints of drill pipe.

Figure 4:
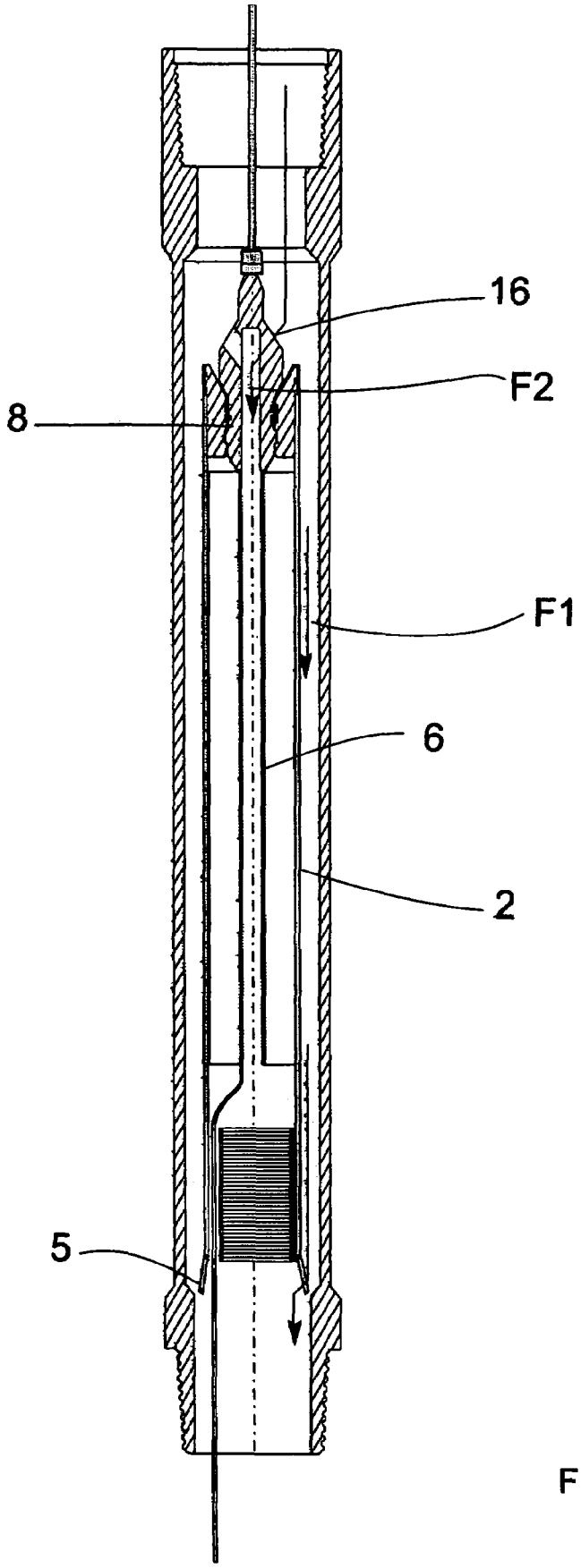
FIG. 4 shows a similar view to FIG. 3 with the spool in the position of being anchored to a section of drill pipe.

FIG. 4 shows a similar view to FIG. 3 with the spool module anchored to a section of drill pipe by anchors 5 which act against the internal upset 14 at the lower joint of the last connected drill pipe section. Fluid flow F2 is possible both through the inside of the module through ports 16 in the stinger 8 and also around the outside as shown at F1. This ensures that the drilling process can continue uninterrupted as new sections of drill pipe are added and the cable is paid out and anchored.

Figure 5:
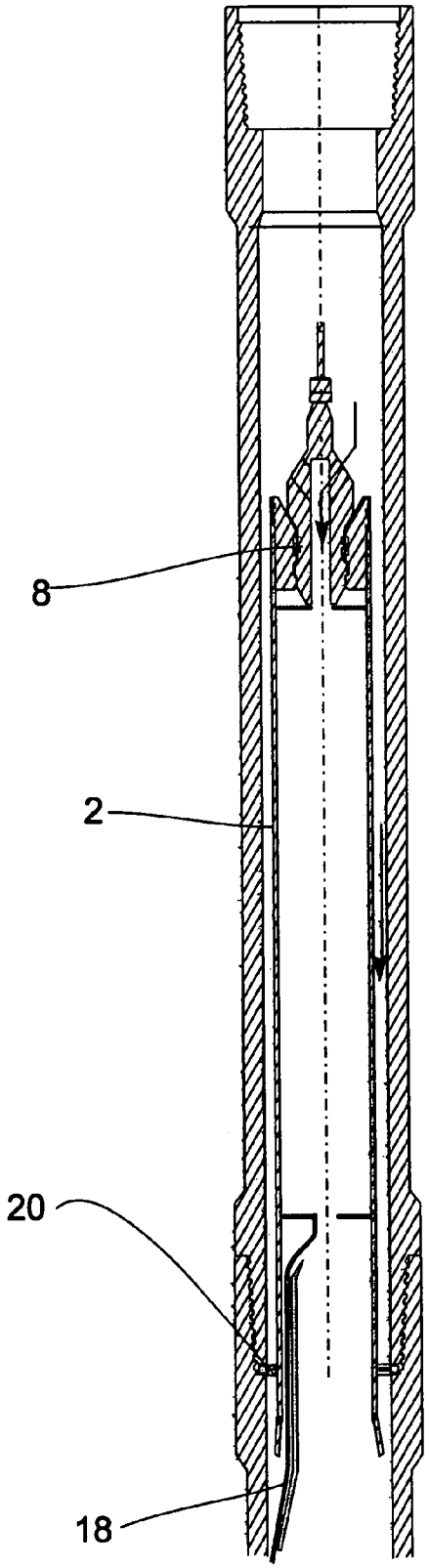
FIG. 5 shows a similar view to FIG. 3 with the spool including a guide means for the cable and cable anchoring means arranged in the drill pipe.

FIG. 5 shows a further embodiment of the anchoring means for the cable to the inside wall of the pipe. The same components have the same references and the spool module 2 includes a guide means 18 for feeding for the cable to the desired position against the inside wall of the drill pipe, and as in previous embodiments, fluid flow is both in the annulus around the spool holder and through a central bore of the spool holder. In this embodiment a cable clamp is arranged at the joint of two corresponding pipe sections and held open before being activated to engage the cable and grip it to the pipe section. A j-pin may be used to correctly orient the spool holder.

Figure 6:
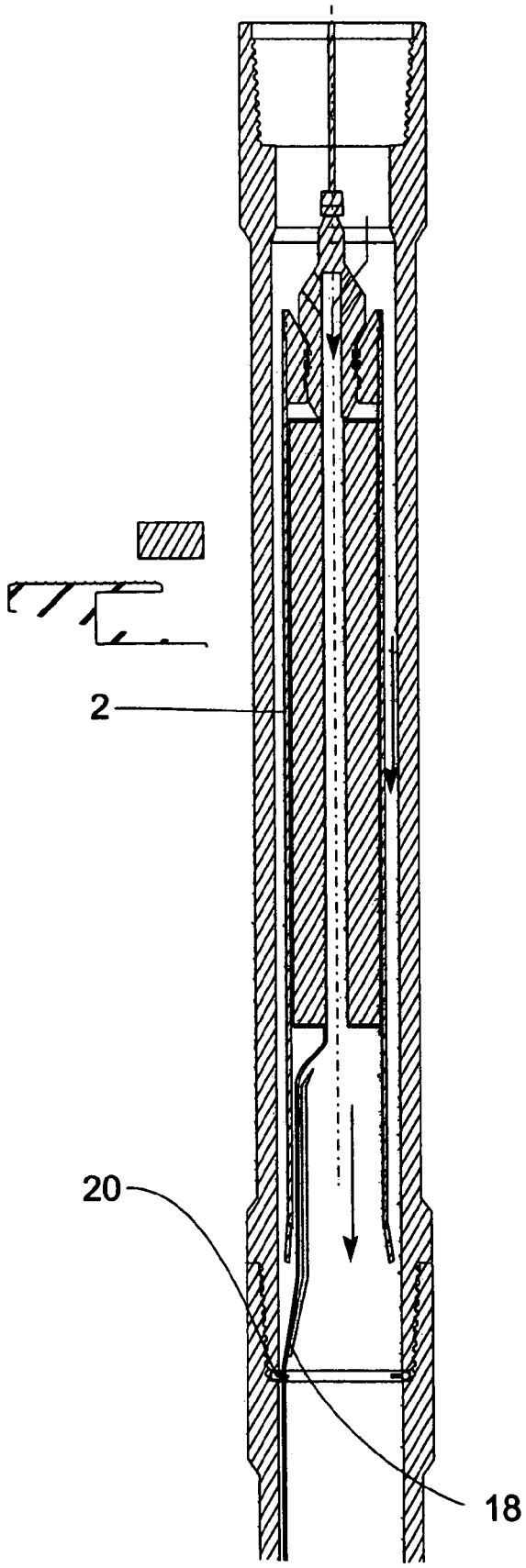
FIG. 6 shows a similar view of FIG. 5 after the cable anchoring means having been deployed.

FIG. 6 shows a similar view to FIG. 5 after drill pipe has moved downwardly and the cable anchoring means having been deployed, and the cable clamp has pivoted to retain the cable after the spool holder has moved past.

FIG. 7 shows a further embodiment of the anchoring means provided by a magnetic means on the cable. This embodiment also includes a feeder 18 to push the cable against the inside wall of the drill pipe so that it becomes attached by means of magnetism. In this case the cable guide or feeder 18 would need to be made from a suitable non magnetic material, probably a suitable plastic.

FIG. 7*a* shows one form of the magnetic means on the cable in the form of a flexible magnetic tape 22 which in this embodiment is adhered to the steel casings 6 of the twin fiber optic cables 6*a*. FIG. 7*b* shows an embodiment of the magnetic means in the form of a magnetic layer 23 completely surrounding the casing 6 of the fiber optic cable 6*a*. The tape and magnetic layer preferably consist of a permanently magnetic material.

FIG. 7*c* shows an embodiment of a magnetic means being provided by magnetizing the steel casing or sheath 6 around a copper conductor 6*a* by means of a magnetizing coil 24 to effectively permanently magnetize the steel casing. This can be carried out shortly before the cable is paid out so that the magnetic effect does not effect the handling of the cable up to that point but the cable will then affix itself to the inside wall of the steel drill pipe by means of its magnetic attraction.

Figure 7D:
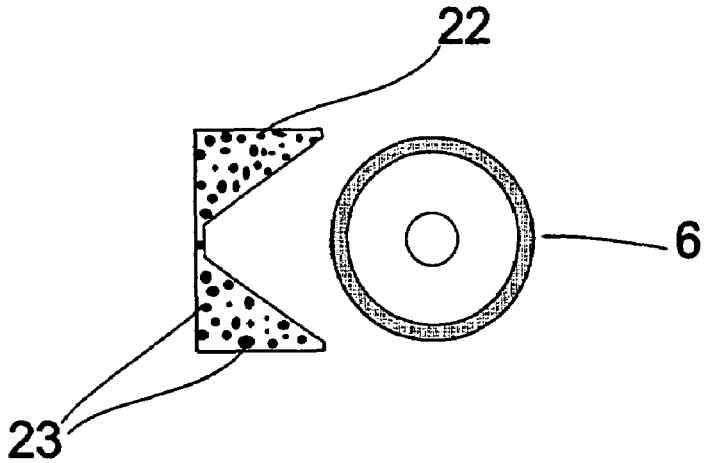
FIGS. 7*d* to 7*f* show the attachment of the magnetic tape to the cable and the inside wall of the drill pipe.
Figure 7E:
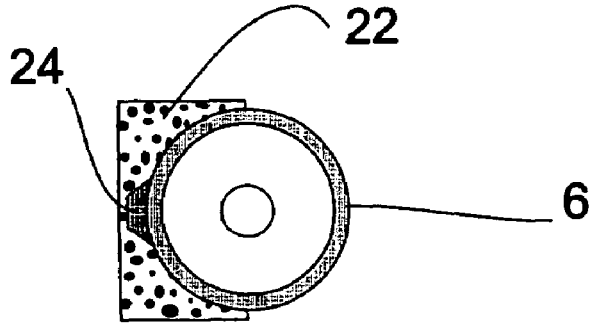
Figure 7F:
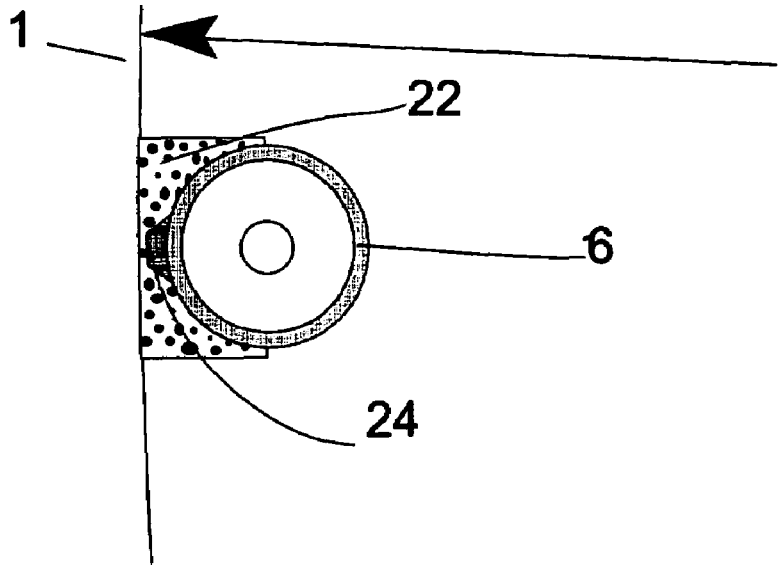

FIGS. 7*d* to 7*f* show the attachment of the magnetic tape to the cable and the inside wall of the drill pipe. In FIG. 7*d* a V shaped recess 23 is formed in the tape 22 in which the cable 6 is pressed, and the V shaped tape deforms around the curved outside surface of the cable 6. Ferrous particles 23 within the tape provide the required magnetically attracting properties. Preferably, as shown in FIG. 7*e* adhesive is applied at the bottom of the V and this serves to secure the cable and magnetic tape together. The flat surface of the magnetic tape is then attracted and magnetically attaches to the inside wall of the drillpipe 1.

Figure 8:
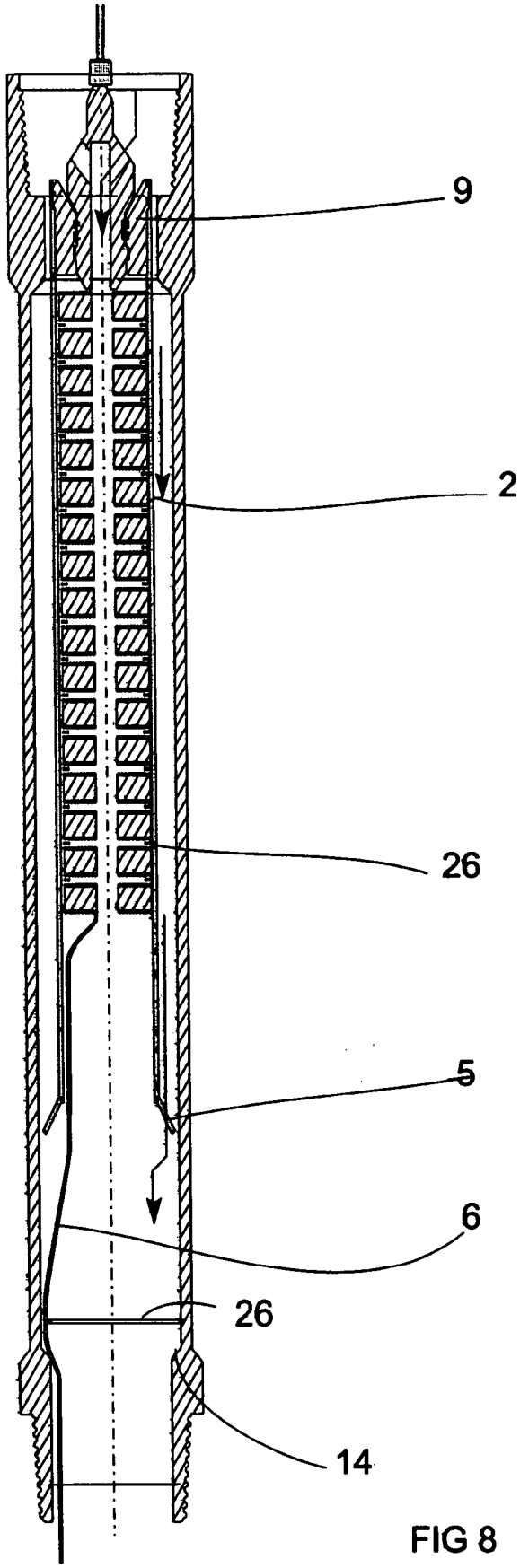
FIG. 8 shows a the spool including ring shaped anchors arranged intermittently along the length of the cable.

FIG. 8 shows a the spool 2 including ring shaped anchors 26 arranged intermittently along the length of the wound cable 6. The ring shaped anchors 26 are released as the cable is paid out (each anchor being released as the spool portion beneath it is exhausted) and the anchors 26 will become arranged concentrically within the drill pipe and rest against the internal upset 14 of the drill pipe 1.

Figure 9:
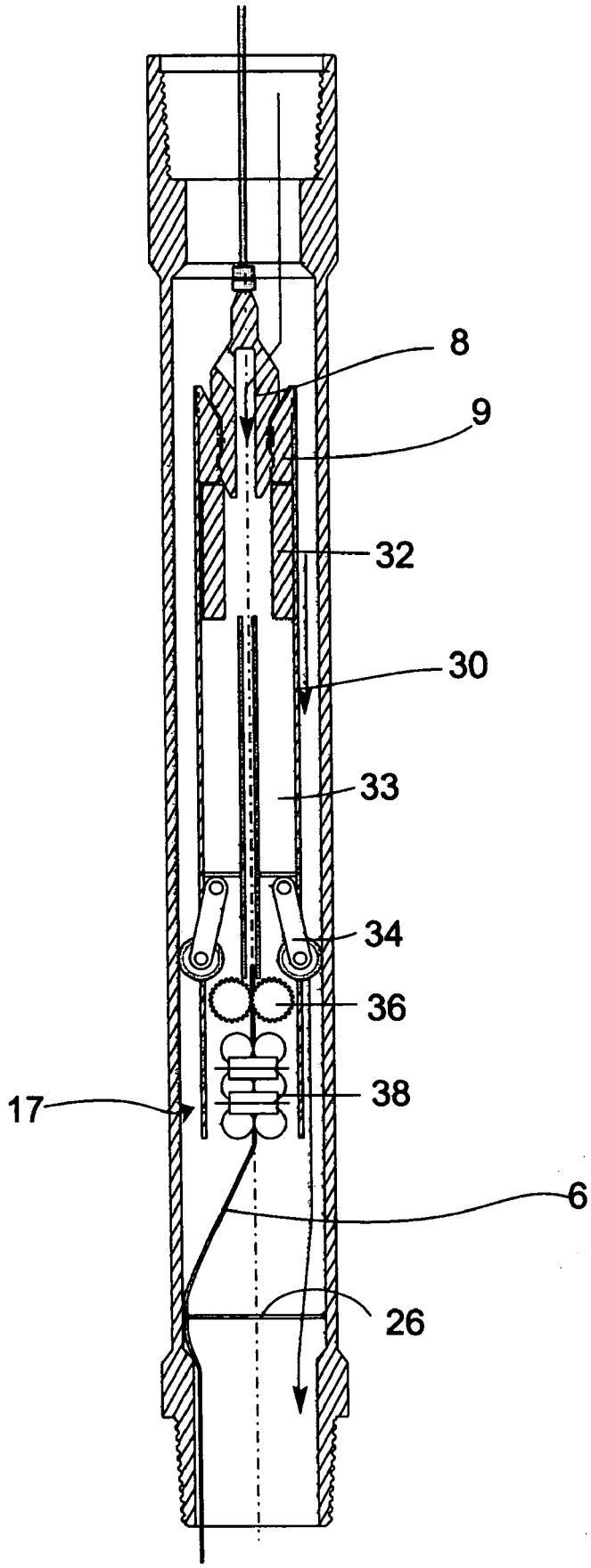
FIG. 9 shows a means of removal of the cable and anchors.

FIG. 9 shows a means of removal of the cable 6 and anchors 26. A cable removing tool 30 is introduced into the well. The cable removing tool 30 includes a battery pack 32 a storage bin 33, guide wheels, or walk down wheels 34 for driving the removing tool along the inside wall of the pipe, chopping means 36 to break up the cable and anchors into small pieces and a cable gripping means 38 to grip the cable and feed it into the removing tool.

FIGS. 10*a* to 10*d* show an embodiment of a magnetic attaching means and its removal. The original cable 6 having a fiber optic wire 6*a* shown in FIG. 10*a* is encased in a layer of extrudable magnetic material 19 including a dissolvable metal component such as magnesium, shown in FIG. 10*b*. Such a layer could comprise particulate ferrous material, dispersed in magnesium and extruded around the outside of the cable. Thus when it is required to remove the cable acetic acid is pumped past the cable to rapidly dissolve the magnesium and so release the magnetic particles which disperse and are carried away by the mud, as shown progressively occurring in FIGS. 10*c* and 10*d*.

Figure 11:
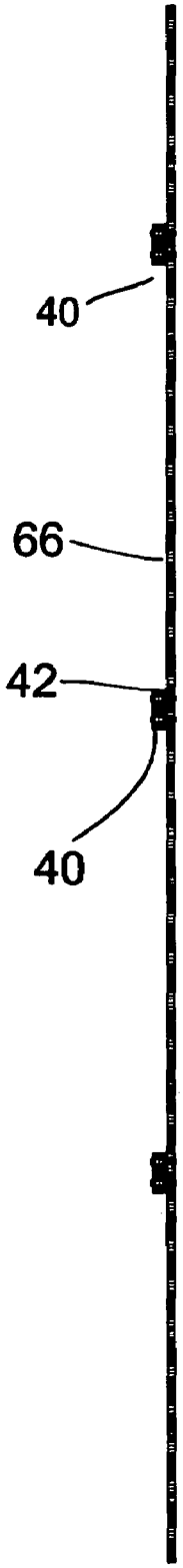
FIGS. 11 to 13 show an alternative embodiment of the use of a magnetic anchoring means.
Figure 12:
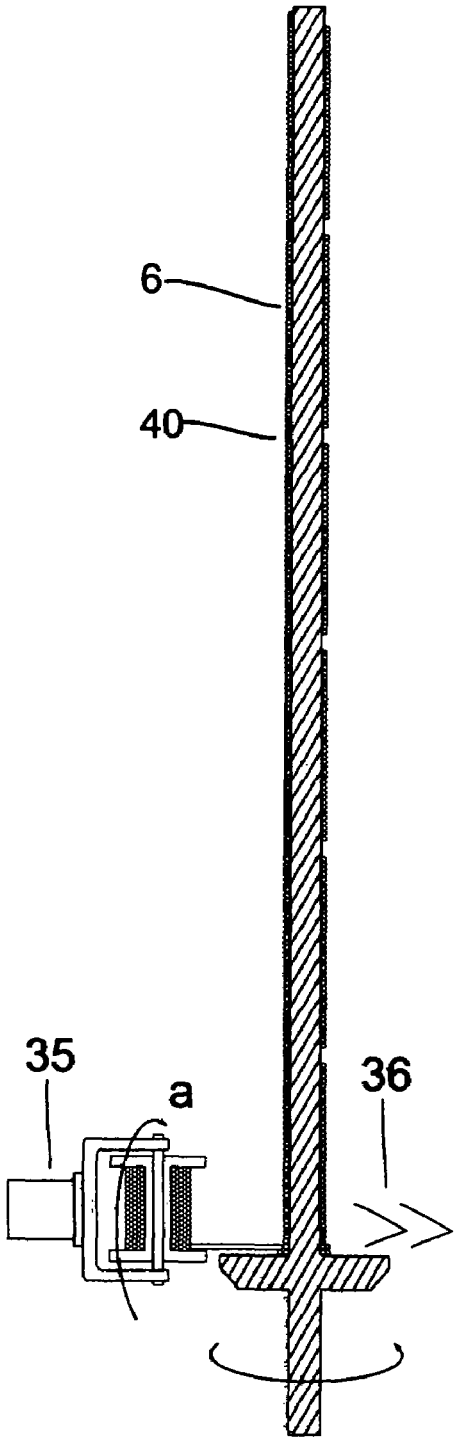
Figure 13:
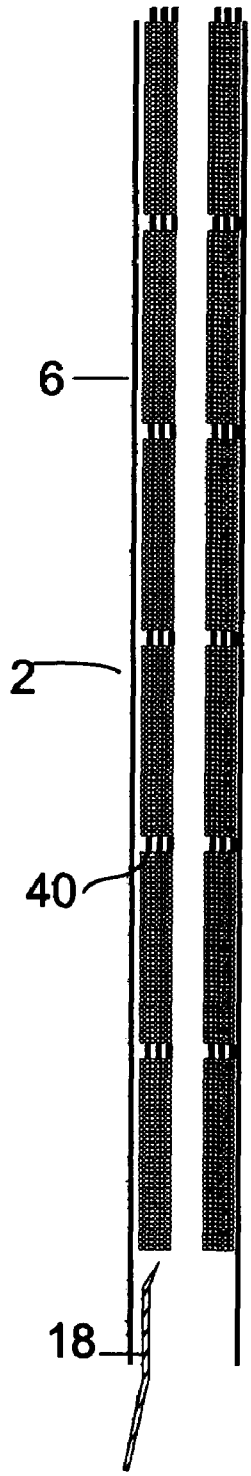

FIGS. 11 to 13 show an alternative embodiment of the use of a magnetic anchoring means. Separate magnets 40 are attached to the cable 6 by attaching means such as straps 42. In FIG. 12 a cable with the magnets 40 already attached is being wound onto a bobbin 44 to formed the cable module 2, the feed spool being rotated in a perpendicular axis to the bobbin as shown by arrow a as the cable is wound onto the bobbin, so that cable is not in a twisted state when it is paid out from the bobbin. The cable may be also be sprayed with silicone in order to releasably secure the cable in its wound configuration. The completed cable module 2 is shown in FIG. 13 with lengths of wound cable interspread with magnets housed in a thin-walled cylinder, the cable module including a cable guide 18 to urge the magnets into attractive contact with the inside wall of the pipe 1.

Figure 14:
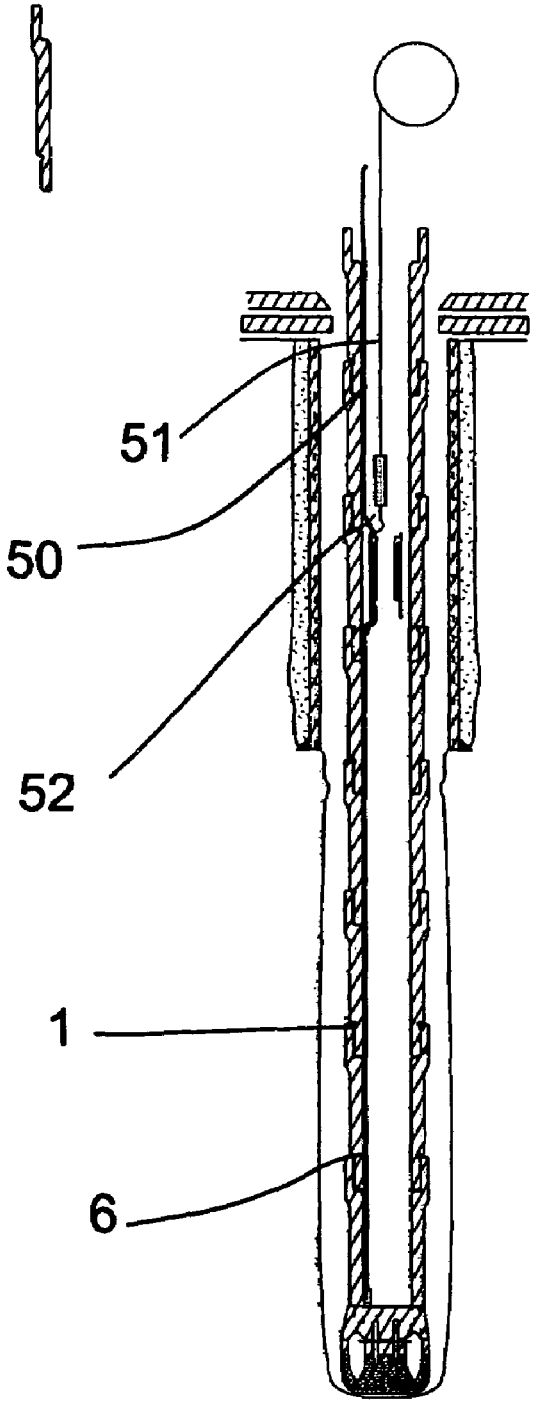
FIGS. 14 and 15 show a method of removal of the cable and anchoring means of the embodiment in FIGS. 11 to 13.
Figure 15:
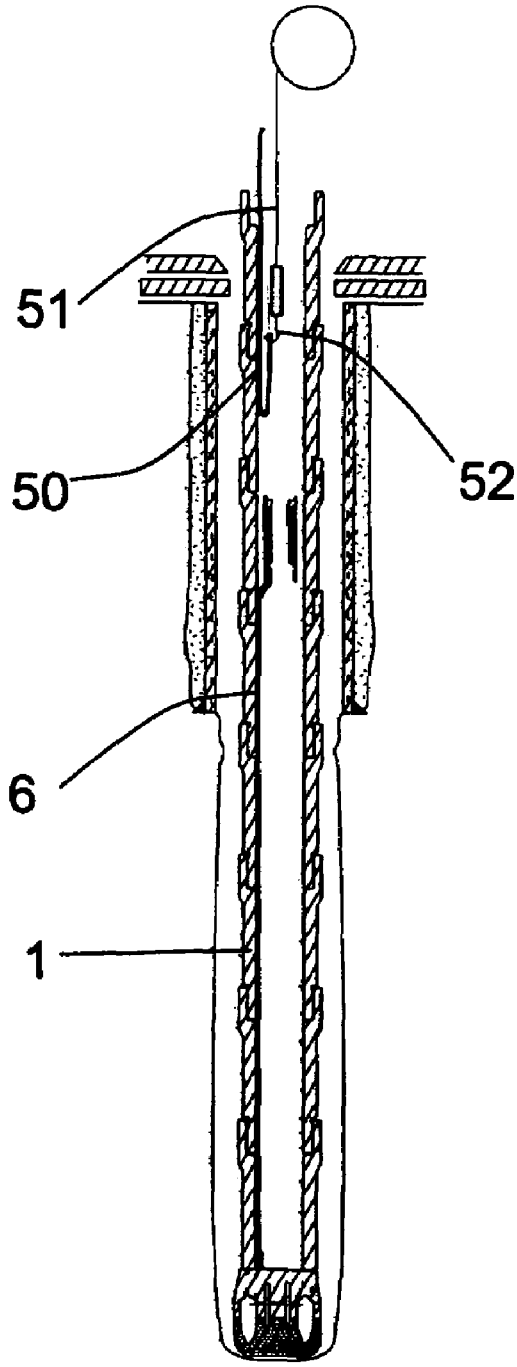

FIGS. 14 and 15 show a method of removal of the cable and anchoring means of the embodiment in FIGS. 11 to 13. A winch line 51 with a fishing hook 52 at the lower end of it is lowered into a pipe line in which the already installed cable is present attached by magnetic attaching means. The fishing hook 52 latches onto the cable 6, 50, preferably at a fishing head provided on the cable or the anchoring means. After the cable 50 is disengaged from the spool assembly and the cable 50 above the spool assembly is peeled back away from the inside wall of the pipe 2 the upward force on the winch line is sufficient to overcome the magnetic attractive force of the anchoring means. The force required to remove a single magnets, or small length of magnetic tape, by this 'peeling' technique is relatively small, and once separated from the wall of the drill pipe, the magnetic attraction is very much reduced and the line and magnets may be removed easily.

Figure 16:
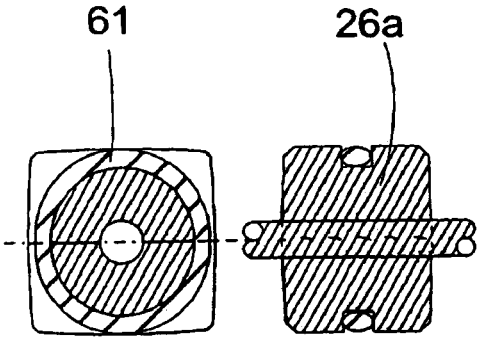
FIGS. 16 to 19 show a further embodiment of a magnetic fixing means for the cable.
Figure 17:
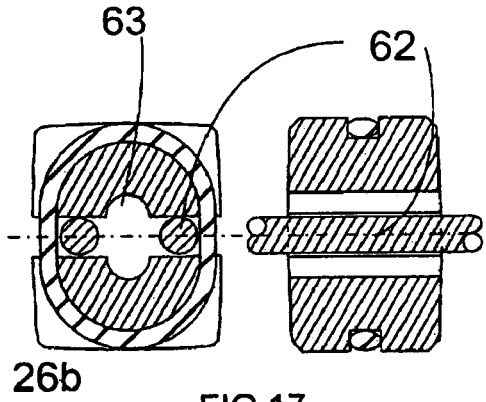
Figure 18:
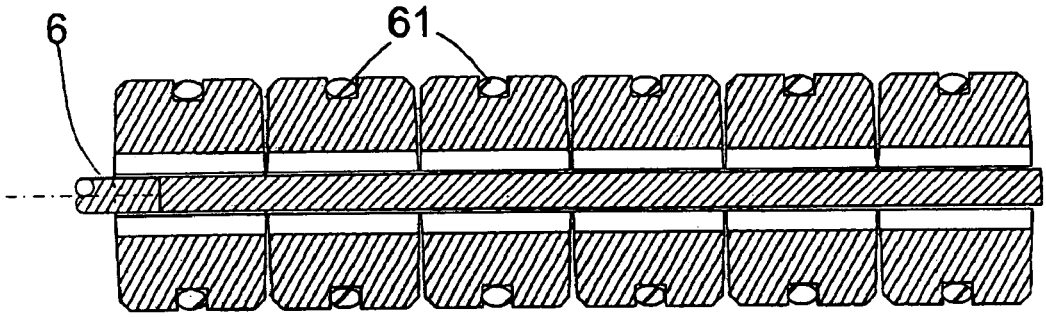
Figure 19:
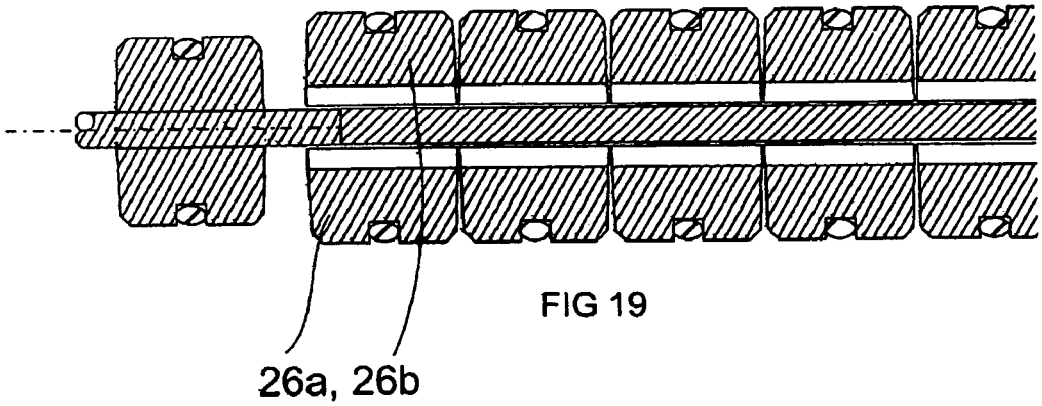
Figure 20:
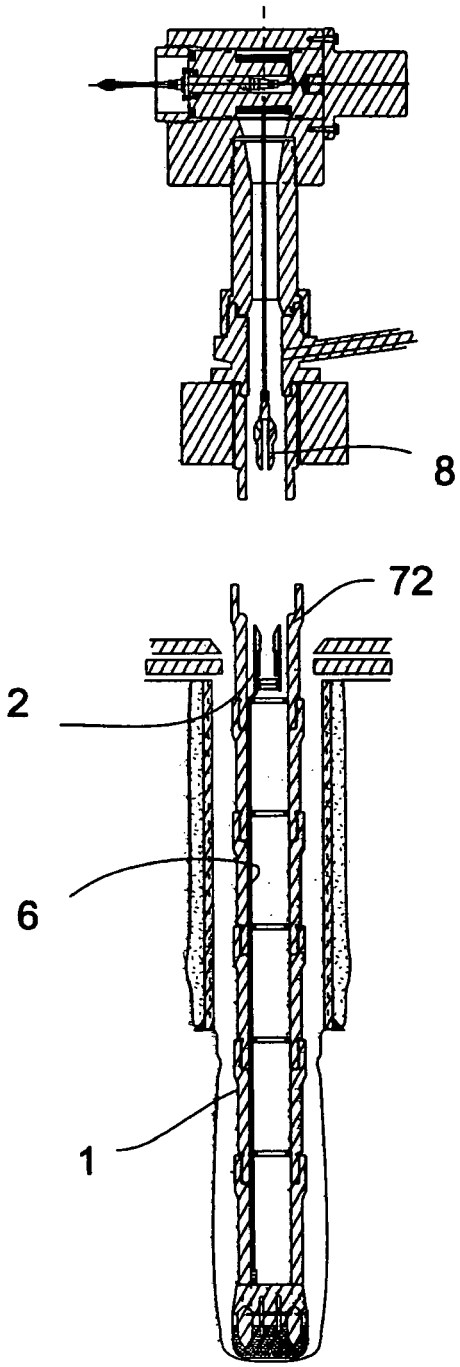
FIGS. 20 to 23 show the accomplishment of a wiper trip.

A further embodiment is shown in FIGS. 16 to 19, in which magnetic elements are provided along the length of the cable to attach the cable to the inside wall of the pipe. In this embodiment the magnetic elements are fitted to the cable as the cable is deployed and paid out from the spool. FIG. 16 shows the magnetic element 26 already attached to the cable 6 and secured thereto by means of an elastic element 61. The magnetic element is provided in two parts 26*a* and 26*b* and before the magnetic element is deployed these two parts are held apart against the retaining force of the elastic element 61 by a holding rods 62. These holding rods extend along the entire length of a number of magnetic elements corresponding ideally to the number desired to be deployed for the entire length of cable provide on the spool. The cable also runs between the entire number of magnetic elements and is arranged between the two holding rods 62 is the space provided by two semi-circular grooves 63 one in each of the magnetic element parts 26*a*, 26*b*. When it is required to attach a magnetic element to the cable the rods 62 are moved laterally away from the deploying end of the spool operated automatically by means of a motorized screw or the like, such that when the rods are free of the outermost magnetic element the two parts 62 cease to be held apart by the rods 62 and are forced together by the elastic element 61 and so grip the cable 6 and are fixed to it.

The magnetic elements are guided to the inside wall of the pipe by the guide 18 so that the cable and the magnetic elements are out of the main effect of the flow of fluids within the pipe and are also induced to magnetically attach to the inside wall of the pipe.

Figure 21:
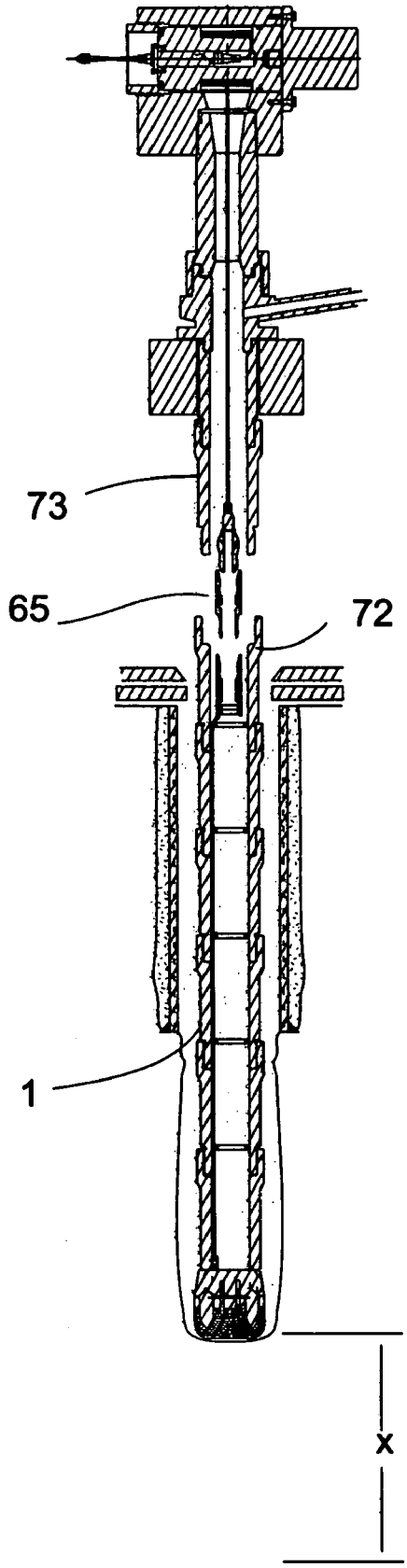
Figure 22:
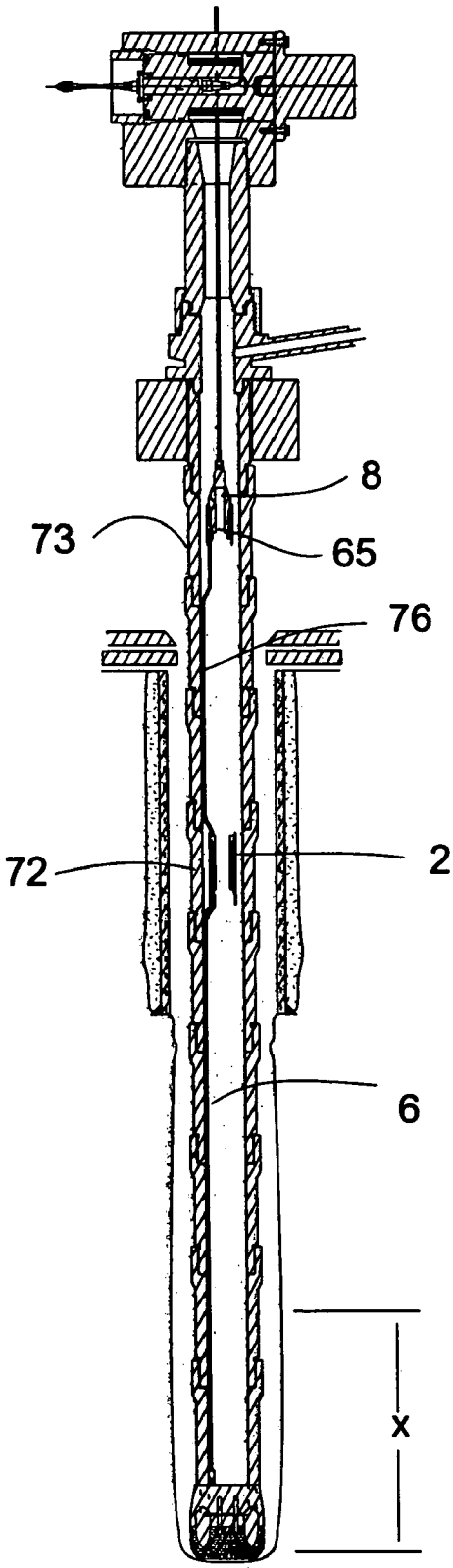

Referring to FIGS. 20 to 23, when a length of borehole has been drilled using drillstring 1 having cable 6 paid out from a main spool 2 and anchored in the drillstring as described, the drillstring's operators may anticipate that subsequent deeper lengths of borehole will require wiper trips to be made to drill out unconsolidated rock material that caves in behind the drill bit. Referring to FIG. 21, before such a length x of borehole is begun, a secondary spool 65 having cable 76 wound around it in the manner similar to that previously in respect of the main spool 2 is introduced into the drillstring, the cable 76 from the secondary spool 65 connecting to the top of the cable 6 from the main spool 2. As the drillstring progresses, as shown in FIG. 22, cable 76 is paid out from the secondary spool 2, which is pulled through each new drillpipe section 73 by the winch and stinger 8 in a similar way to that described for the main spool 2. The main spool 2 remains secured in a descending drillpipe section 72, and does not pay out further cable.

Before returning up the borehole to carry out the wiper trip, the secondary spool 65 and the cable 76 previously paid out from the secondary spool 65 can be recovered and disposed of, or alternatively the secondary spool can wind its cable back onto itself. In general the secondary spool's cable is conventional cable, though of course it too may be anchored using the principles herein disclosed.

Figure 23:
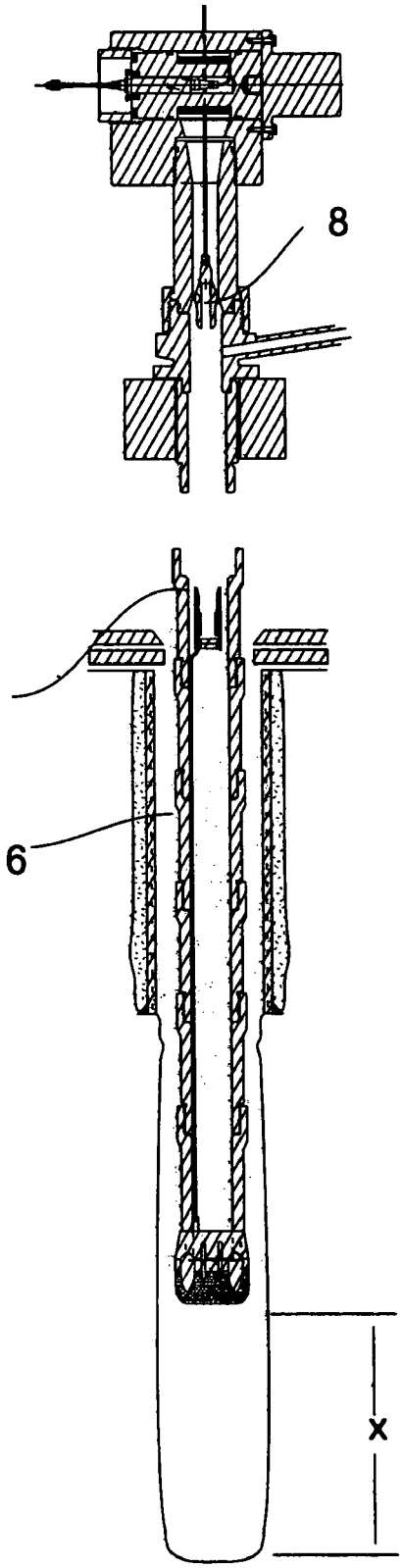

After the wiper trip has been completed, the main spool is situated at the top of the borehole, as shown in FIG. 23. As it is often necessary to complete several wiper trips over any one length of borehole (though of course this depends upon the characteristics of the rock), for each subsequent wiper trip a new secondary spool is installed in the drillstring. In this way, the drillstring's operators can be assured that during these wiper trips the cable beneath the main spool is secured anchored. It is of course possible that after a wiper trip has been completed, the main spool could be used once more to pay out cable (without using a secondary spool). But in general this is not envisaged.

Referring to FIGS. 24 to 27 a further embodiment of the invention is shown in which the cable comprises an outer material of an rubberized or elastomeric substance 66 comprising concave shapes or dimples 67 in its outer surface which serve to provide a suckering effect between the cable and the inside wall of the drill pipe 1. In this embodiment the dimples 67 are provided on fours sides around the circumference of the cable 66 so as to provide a suction effect regardless of the orientation of the cable 66 and the dimples 67 are also located regularly along the length of the cable 66.

Figure 26:
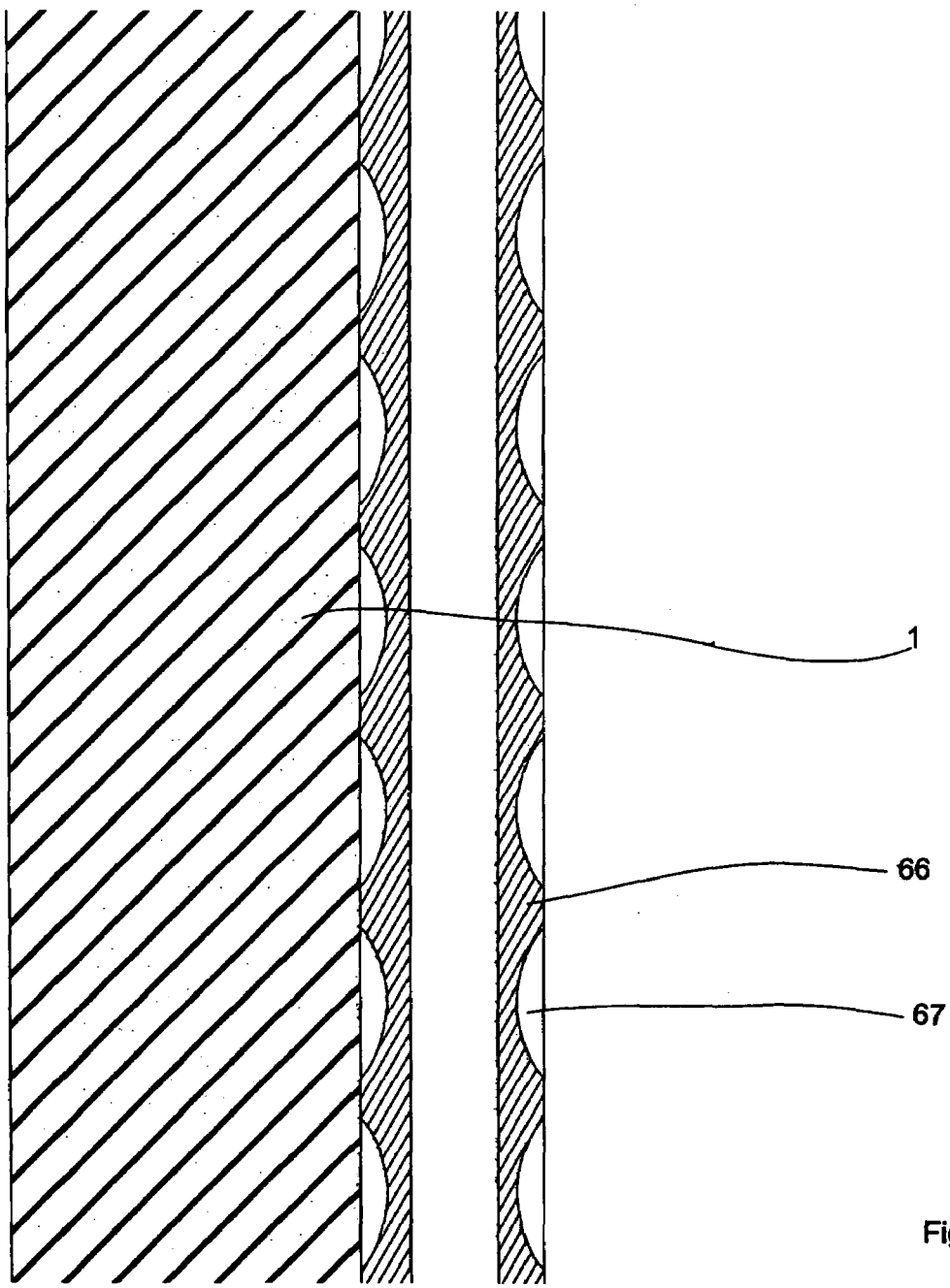
FIG. 26 shows a longitudinal section of the cable in FIG. 24 in the fitted position secured to the drill pipe.
Figure 27:
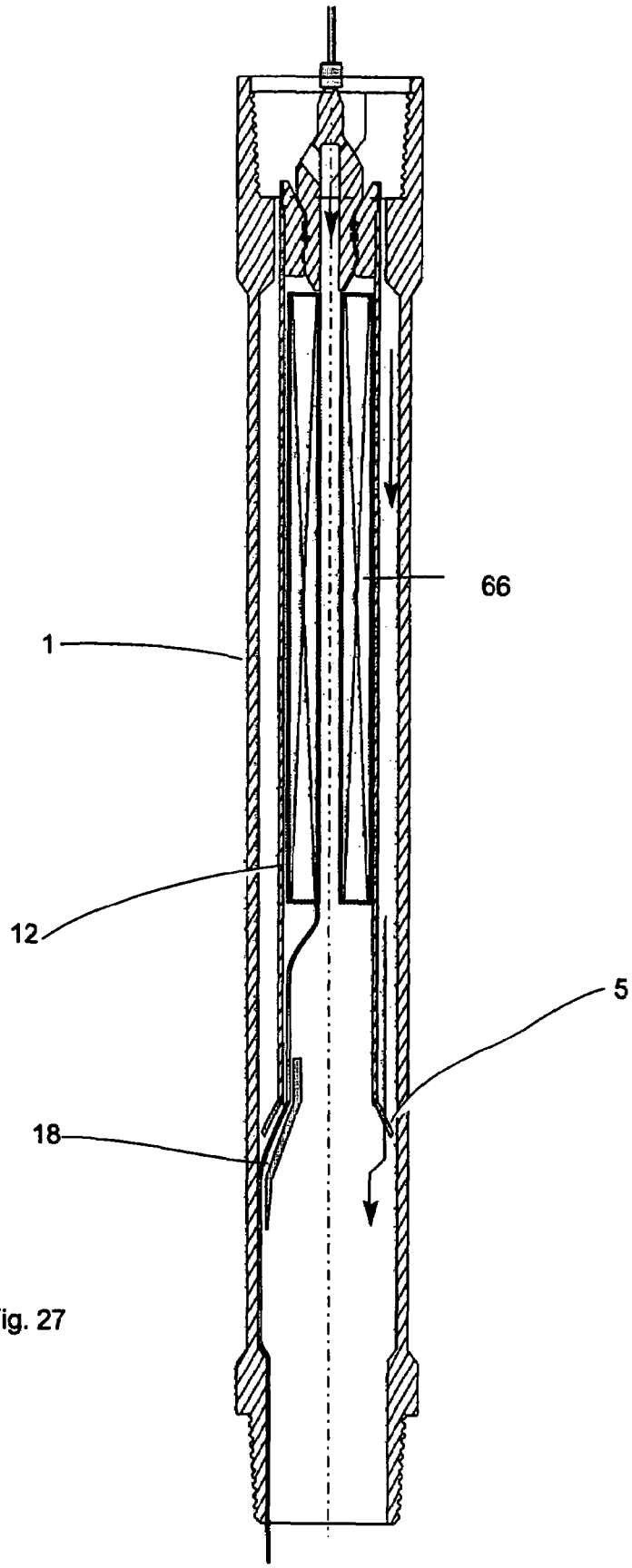
FIG. 27 is a longitudinal section of a drill pipe including the cable of FIG. 24 being installed.

FIG. 26 shows the cable 66 in position secured against the inside surface of the drill pipe 1. Once establish the suction pressure will be substantial as it will be increased by the increasing hydrostatic pressure as the drill pipe progresses down the well. In FIG. 27 it can be seen that the rubber coated suction pad cable 66 is deployed in a similar way to the previous embodiment with the guide 18 urging the cable 66 against the inside wall of the drill pipe 1 preferably resulting in a pressing of the cable against the wall so that a little air is urged out of the cavity formed by the concave dimple and the wall of the casing causing the suction effect as the elastomeric material of the wall of the cable recovers immediately following the release of the pressing effect by the guide 18.

Figure 28:
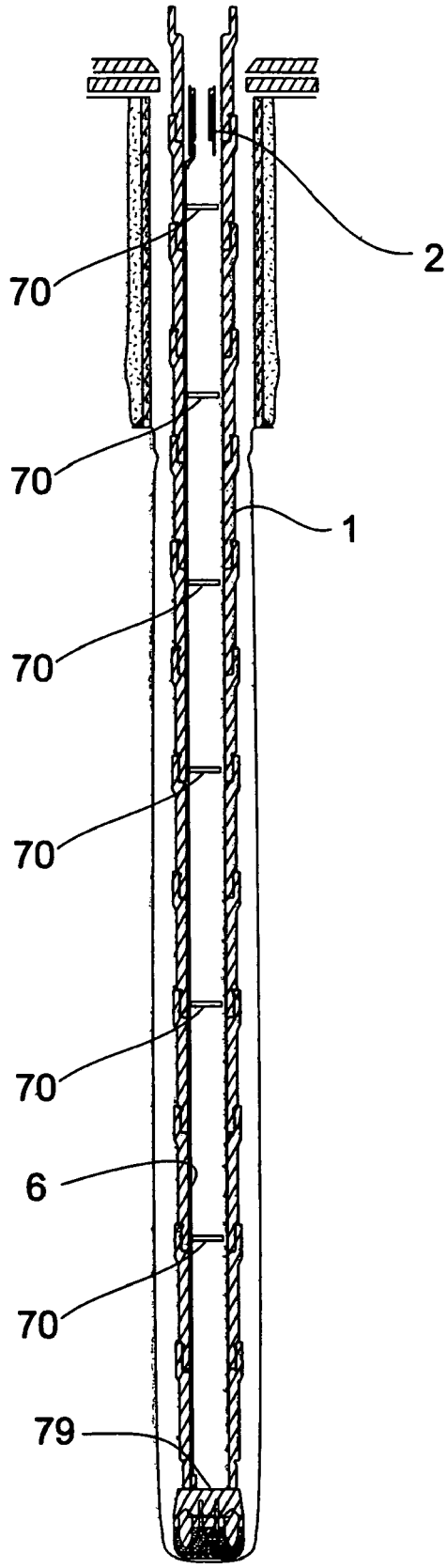
FIG. 28 is a longitudinal section of another embodiment of the cable system installed in the drillpipe.

Referring to FIG. 28 a cable 6 terminates at the bottom of the bore of drill string 1 as previously described. The cable extends up the drillstring 1, being secured by grippers 70 located at regular intervals along the drillstring. In this embodiment, these grippers could typically be located in ever 1000 feet (though naturally this could be varied, and will depend upon the type of cable; as in the first embodiment, where armored cable is employed, the grippers may be more frequently deployed), so that for standard length drillpipe sections of about 30 foot, a gripper 70 will be located in every thirtieth drillpipe section. Additional cable is stored wound around a the spool of a cable module 2 of a which is suspended near the top of the drillstring.

Figure 29:
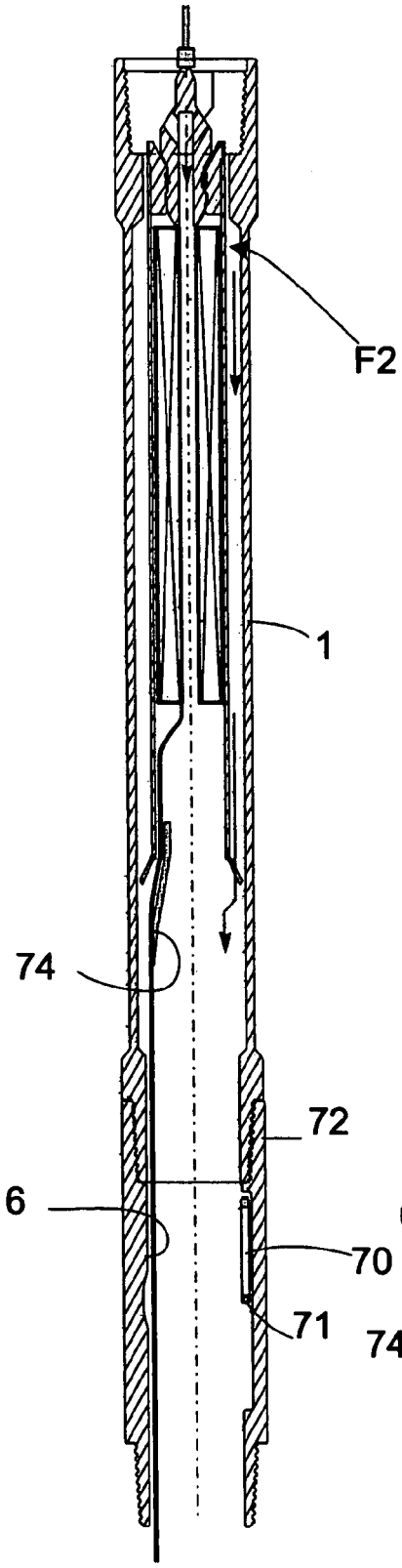
FIGS. 29 to 31 are longitudinal sections of this embodiment showing cable being installed.

The cable module and top of the drillstring is shown in more detail in FIG. 29. Each gripper 70 is attached to the inner bore of a drillpipe section 72 on a hinge 71. When the drillpipe section is made up on the drillstring 1, the gripper 70 is in a retracted position as shown. As further drillpipe sections are added, the cable module 2 is threaded through the newly added drillpipe sections using a fishing tool and wireline; as previously described, ratcheted supports allow the cable module to be dragged through drillpipe sections but resist the cable module passing downwardly past the internal upset of the drillpipe sections. As the drillstring is extended, cable is paid out from the cable module, and guided to one side of the drillstring's bore by a tongue 74. As for the previous embodiments, the cable module ideally includes a through path F2 so that drilling fluid is not impeded even when the widest portions of the cable module are passing through the narrowest portions of the drillstring's bore.

Figure 30:
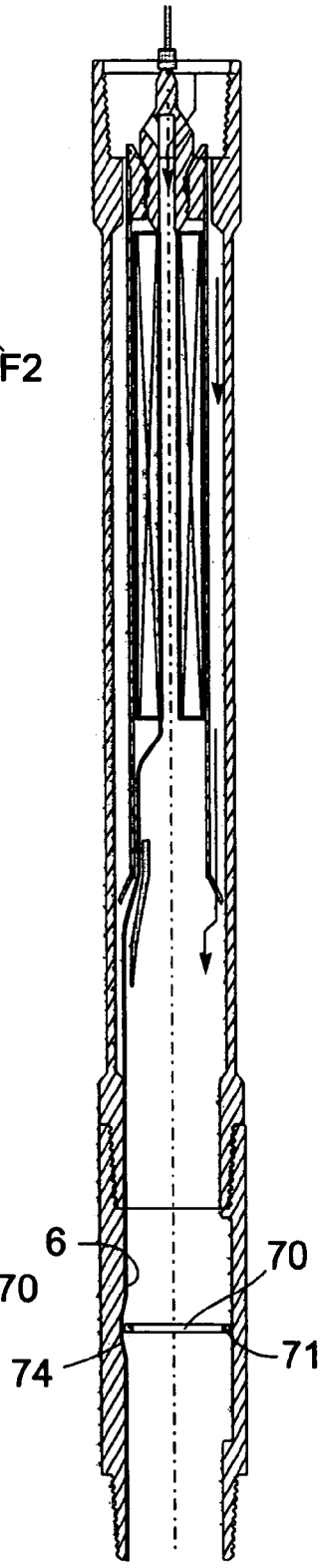
Figure 31:
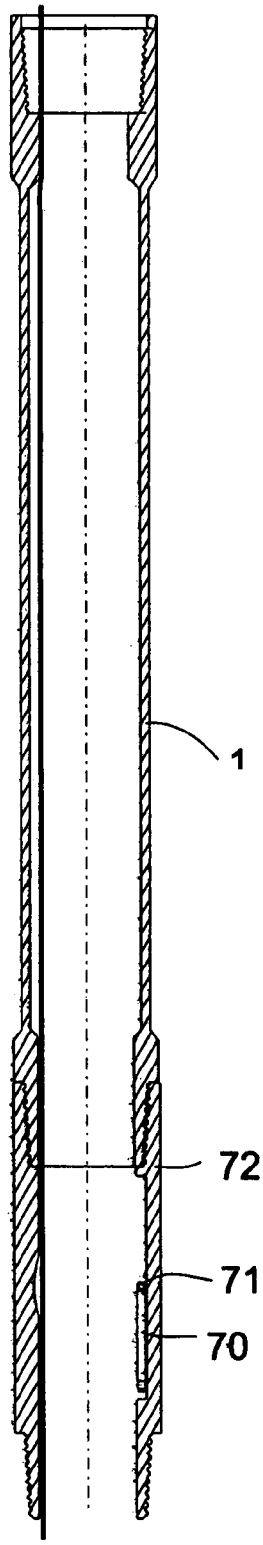

Referring to FIG. 30, when it is desired to secure the cable 6 to the side of the drillstring bore, the gripper 70 is activated so as to pivot through 90 degrees to a horizontal position. The wall of the drillpipe section opposite the grippers hinge has a concavity 75 arcuate in profile, to accommodate the sweep of the gripper. The cable 6 is securely pressed against the side of the drillpipe section by the gripper 70. Referring to FIG. 31, when the drillstring 1 is being withdrawn from the borehole and the individual drillpipe sections are removed, the grippers 70 may be deactivated to release the cable 6.

The activation of the grippers may be achieved by hydrostatic means, i.e. by increasing the hydrostatic pressure in the well to particular levels, of by other smart or remote means. Alternative methods will be described below.

Figure 32:
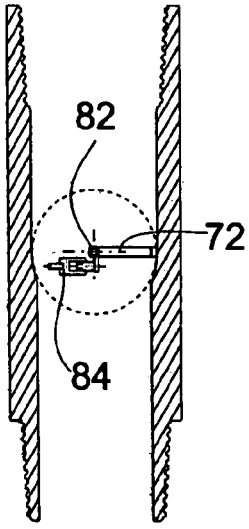
FIGS. 32 to 35 are longitudinal sections of the grippers of this embodiment in use.
Figure 33:
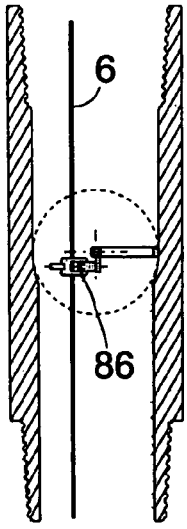
Figure 34:
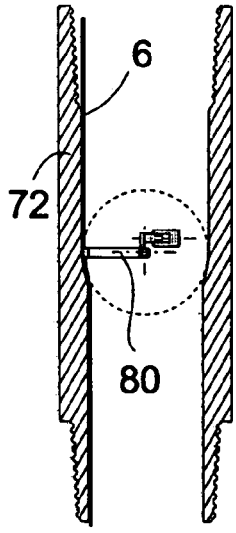
Figure 35:
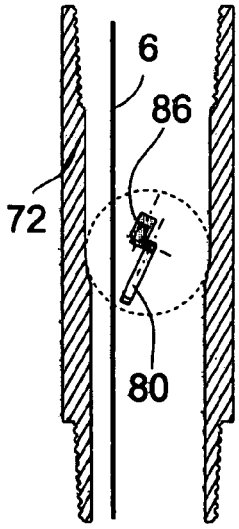

It will be realized that the gripper may be implemented or configured in different ways. Referring to FIG. 32, a gripper 80 is fitted inside a drillpipe section 72 secured by and pivoting upon a hinges 82 that engage on opposite points across the circumference of the drillpipe section's bore; the internal profile of the drillpipe section 72 is modified to accommodate the sweep of this gripper. As shown in FIG. 33, the cable 6 is threaded through the new drillpipe section 72 (the gripper is preferably shaped, for example in a C-shape, so as to accommodate the passage of the cable module). Referring to FIG. 32, the gripper 80 is controlled by a fuse 84 constraining the gripper's hinge (which is biased by a spring to urge the gripper to rotate through an activated position), which initially activates to pivot the gripper and grip the cable on contact with drilling fluid. The fuse is ideally set to activate the gripper's pivoting after a set time period e.g. 30 minutes, after the first contact with the drilling fluid. When it is desired to release the cable, a set pressure (say 5000 psi) is applied to the drillstring at the surface, and a piston 86 in the gripper causes a shear pin to fail as shown in FIG. 35, deactivating the gripper which is then freed to pivot downwards, and releasing the cable 6 which may then be winched up and recovered.

Figure 36:
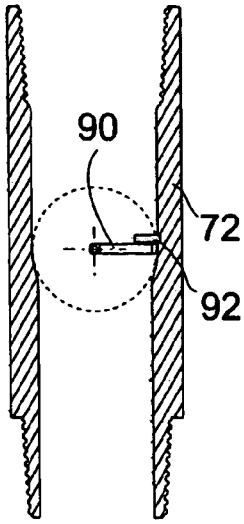
FIGS. 36 to 39 are longitudinal sections of a another embodiment of the grippers in use.
Figure 37:
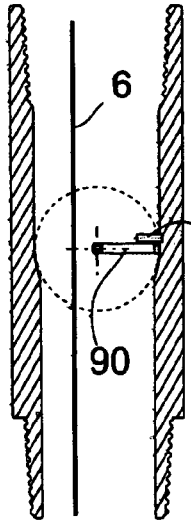
Figure 38:
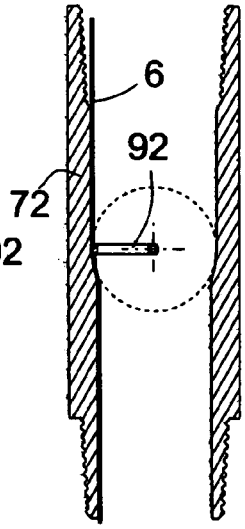
Figure 39:
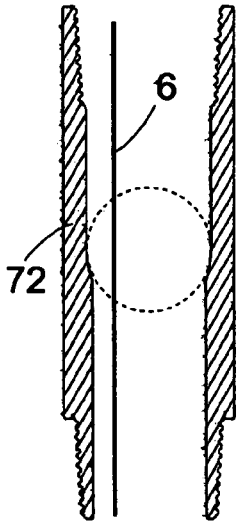

Referring to FIGS. 36 and 37, in an alternative embodiment a first fuse 92 is situated at the gripping region of the gripper 90, which it interlocks with a groove 93 on the inner surface of the drillpipe section 72. Once again, the cable 6 is introduced to the drillpipe section. The first fuse 92 may be composed of magnesium, so that it starts to dissolve with components of the drilling fluid when the drilling fluid comes into contact with the gripper 90. After a set time period, say around 30 minutes, the first fuse 92 has dissolved to the extent that the gripper 90 is free to pivot into an activated position and grip the cable against the inner wall of the drillpipe section, as shown in FIG. 38. Some or all of the gripper (or its pivoting support pins) is composed of titanium. When it is desired to release the cable, fluoride is introduced into the circulating fluid, causing the titanium to dissolve and the remaining parts of the gripper to falls away, releasing the cable as shown in FIG. 39.

Figure 40:
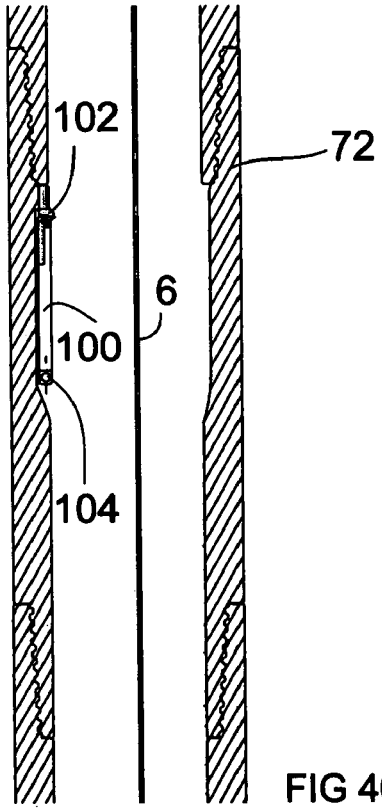
FIGS. 40 to 41 are longitudinal sections of a further embodiment of the grippers in use.
Figure 41:
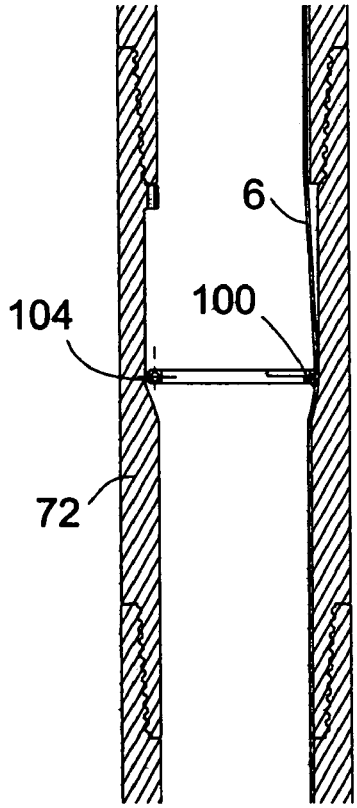
Figure 42:
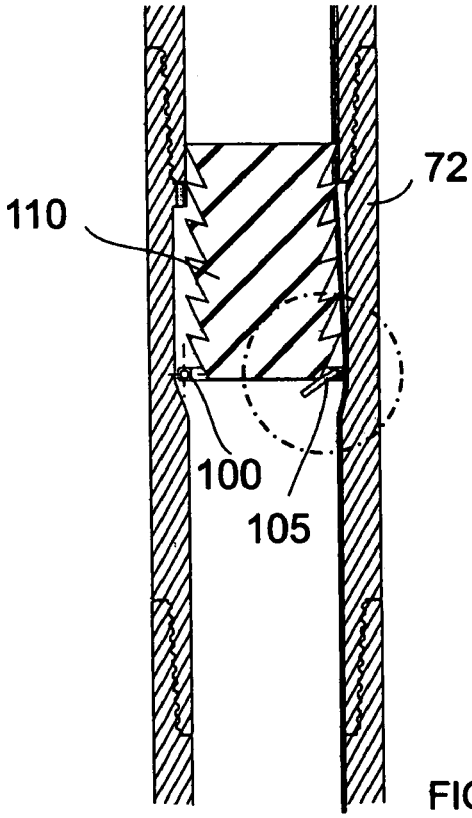
FIGS. 42 to 43 are longitudinal sections of this embodiment being removed.
Figure 43:
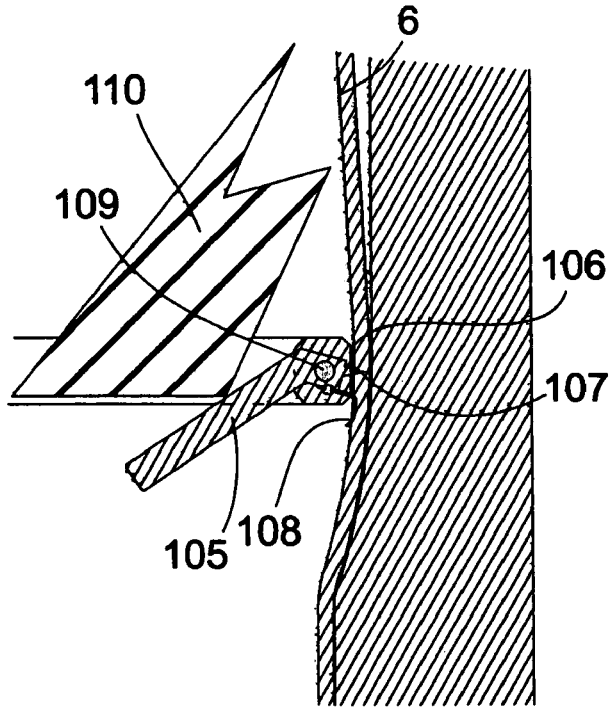

Referring to FIG. 40, in a similar manner to previous embodiments, a hinged gripper 100 is located inside the drillpipe section 72. The hinge 104 is spring-loaded, and biased to pivot to the horizontal position, but is held in a deactivated, vertical state by a fuse 102. The fuse 102 is composed of magnesium, and dissolves after prolonged contact with the drilling fluid (typically 30 minutes, though of course this can be varied as desired). When the fuse has dissolved, the spring-loaded hinge 104 pivots the gripper 100 to a vertical position as shown in FIG. 41, to anchor the cable 6 to the drillpipe section wall.

The gripper 100 shown in this embodiment is generally annular, with a diameter somewhat less than the internal diameter of the drillpipe section 72. Referring also to FIGS. 38 and 39, the annular gripper 100 includes a gripping surface 106 an the outside edge of the gripper, on the portion of the gripper opposite the gripper's hinge 104, which engages with the cable 6 and urges it securely against the side of the drillpipe section 72. Also provided by the gripper at this region is a release arm 105, which comprises an arm set upon a hinge 109 upon the gripper, the distal end of the arm extend towards the center of the drillpipe section's bore. On the other side of the hinge 109 is supported a cutter 107 and a resilient gripper hook 108. Referring to FIG. 38, in order to release the cable 6 from the gripper, a wiper plug 110 is introduced to and pumped down the drillstring 1. As the wiper plug 110 passes through the gripper 100, it engages the release arm 105, causing it to pivot, thereby cutting the cable 6 at the point at which it is anchored, and the resilient gripping hook 108 re-anchors the cable 6 beneath the cut. The cable 6 above the gripper may now be retrieved.

In this manner the cable may be retrieved in manageable sections (ideally 1000 to 2000 feet long), as opposed to a single long length of cable (say 20,000 feet) which is prone to becoming snarled and knotted. It can be easily detected when the wiper plug has reached the gripper (since the lower end of the cable no longer be secured), and the pumping of the plug may then be paused until enough drillstring has been removed to access the drillpipe section having the topmost gripper. The top of the next section of cable may then be held whilst the cable is severed at the next gripper.

It will be seen that by securing cable (whether conductive cable, fiber-optic cable or some other type) the cable does not have to support its entire weight, and so need not be engineer to be as rugged and expensive as if such securement were not used but without the risk that the cable will break through the tension it experiences. Should the cable nevertheless break, problems due to snarled knotted lengths of cable (known as 'bird's nests') will be minimized since most of the length of the cable will remain secured by the grippers, and only an individual length between two consecutive grippers will be involved.

Alternative embodiments using the principles disclosed will suggest themselves to those skilled in the art, and it is intended that such alternatives are included within the scope of the invention, the scope of the invention being limited only by the claims.

The invention claimed is:

1. A pipe installation system having a pipe composed of pipe sections which are added and removed to increase and decrease a length of the pipe, the system comprising:

a length of cable;

cable storage means for stowing the cable in a compact manner inside the pipe and for paying out the stowed cable when the length of the pipe is increased such that the paid-out cable is deployed along the increased length of the pipe; and anchoring means for attaching the cable to an inside surface of the pipe at predetermined locations spaced along the pipe with respective anchors as the cable is deployed in the pipe.

2. The pipe installation system according to claim 1 wherein the anchors are attached to the cable at predetermined positions spaced apart along the cable.

3. The pipe installation system according to claim 2, wherein the anchors each consist of a ring-shaped wire of an outside dimension corresponding approximately to an inside diameter of the pipe.

4. The pipe installation system according to claim 1, wherein the anchoring means includes magnetic elements attached to the cable at predetermined positions spaced apart along the cable and serving to attach the cable to the inside surface of the pipe magnetically at the locations.

5. The pipe installation system according to claim 1, wherein the cable includes a sheath of permanently magnetizable material that is magnetized shortly before deployment.

6. The pipe installation system according to claim 1, wherein the sheath is at least partially formed by a magnetic flexible tape attached to a conductor of the cable or forming a complete outer layer of the cable.

7. The pipe installation system according to claim 1, wherein the anchoring means may be on the inside surface of the pipe and activated as a spool forming part of the cable storage means passes through the pipe.

8. The pipe installation system according to claim 1, wherein the anchors are suction elements attached to the cable at predetermined positions spaced apart along the cable and serving to attach the cable of the inside surface of the pipe by means of suction.

9. The pipe installation system according to claim 1, wherein the cable storage means includes a cable feeder which guides the cable to a desired position inside the pipe.

10. The pipe installation system according to claim 9, wherein the cable is guided against the inside surface of the pipe.

11. The pipe installation system according to claim 1, wherein the cable storage means is a bobbin upon which the cable is wound.

12. The pipe installation system according to claim 1, wherein the cable includes a wireless transmitter capable of transmitting signals to a signal receiver.

13. The pipe installation system according to claim 1, wherein the cable has an upper end releasably connected to a connector, the cable being disconnected from the connector when a new pipe section is to be added or removed and threaded through the new pipe section before being reconnected to the connector, the system further comprising a wireless transmitter on the cable for transmitting signals carried by the cable; and a signal receiving means outside the pipe for receiving the signals.

14. A method of assembling pipe sections to form a pipe and of installing a continuous cable within the assembled pipe, the method comprising the steps of:

supporting a continuous length of cable in a compact manner on a spool releasably connectable to a tension line within the pipe, prior to adding a new pipe section to the pipe, resting the spool on support means within the pipe and disconnecting the tension line from the spool, and thereafter adding new pipe section and thereafter reconnecting the tension line to the spool to support the spool as the new pipe section is progressively fitted, and thereafter pulling the spool up through the new section while simultaneously paying out of the cable from the spool and connecting the cable with anchors to an inner surface of the pipe at locations spaced apart along the pipe.

15. The method according to claim 14 characterized in that the cable transmits data to surface whilst the spool is connected to the tension line.

16. The method according to claim 15, wherein data is transmitted from the cable to the surface while the spool is disconnected from the tension line by means of a radio-frequency connection.

* * * * *